US008277171B2

(12) United States Patent
Kopmels

(10) Patent No.: US 8,277,171 B2
(45) Date of Patent: Oct. 2, 2012

(54) AEROFOIL

(75) Inventor: Michiel Kopmels, Bristol (GB)

(73) Assignee: Rolls-Royce PLC, London (GB)

( * ) Notice: Subject to any disclaimer, the term of this patent is extended or adjusted under 35 U.S.C. 154(b) by 961 days.

(21) Appl. No.: 12/385,249

(22) Filed: Apr. 2, 2009

(65) Prior Publication Data

US 2010/0047057 A1 Feb. 25, 2010

(30) Foreign Application Priority Data

Jun. 30, 2008 (GB) ..... 0811819.2

(51) Int. Cl.
*F01D 25/12* (2006.01)
*F01D 5/18* (2006.01)

(52) U.S. Cl. ..... 415/115; 415/116; 416/97 R

(58) Field of Classification Search ..... 415/115, 415/116; 416/97 R
See application file for complete search history.

(56) References Cited

U.S. PATENT DOCUMENTS

| | | | | |
|---|---|---|---|---|
| 5,660,523 | A | 8/1997 | Lee | |
| 6,190,129 | B1 | 2/2001 | Mayer et al. | |
| 6,602,052 | B2 | 8/2003 | Liang | |
| 6,790,005 | B2 | 9/2004 | Lee et al. | |
| 7,927,072 | B2 * | 4/2011 | Boury et al. | 416/97 R |
| 2004/0179940 | A1 | 9/2004 | Liang | |
| 2006/0257257 | A1 | 11/2006 | Deschamps et al. | |
| 2008/0118367 | A1 | 5/2008 | Liang et al. | |
| 2009/0304520 | A1 * | 12/2009 | Brittingham et al. | 416/97 R |

FOREIGN PATENT DOCUMENTS

EP 1 726 783 A1 11/2006

OTHER PUBLICATIONS

Nov. 29, 2011 Search Report issued in European Patent Application No. 09 25 0866.

* cited by examiner

*Primary Examiner* — David S Blum
(74) *Attorney, Agent, or Firm* — Oliff & Berridge, PLC

(57) ABSTRACT

An aerofoil comprising a pressure-side wall, a suction-side wall and an intermediate wall extending from a free end of the pressure-side wall at an acute angle relative thereto towards the suction-side wall. A cooling fluid passageway extends through a region where the intermediate wall meets the pressure-side wall at an apex. The fluid passageway has an opening, at least in part, in the face of the pressure-side wall.

16 Claims, 4 Drawing Sheets

AEROFOIL

The invention relates to an aerofoil for use in a gas turbine engine.

In operation, gas turbine aerofoils must operate at very high temperatures, typically several hundred degrees above the melting point of the metal. Accordingly, the aerofoils are typically provided with a cooling arrangement whereby cold air is ducted to the interior of the aerofoil, which convectively cools the aerofoil. The air is then passed to the surface to provide film cooling. The rotating aerofoil, or blade, is either shrouded or unshrouded. The blade tip will be subjected to a high heat load caused by the nature of the hot gases. Aerofoil blades in gas turbines often include a tip portion that protects the main body of the blade from damage that might occur due to contact with the turbine casing.

Two typical "squealer" aerofoil blade tip arrangements are shown in FIG. 1 (PRIOR ART) and FIG. 2 (PRIOR ART). In FIG. 1, the squealer tip walls are relatively thin and tall. This arrangement may suffer from high metal temperature at the top of the squealer walls because they are remote from parts of the blade that are convectively cooled. The cooling of the squealer walls is via cooling flow in the tip well, formed between the squealer walls, and film cooling on the aerofoil's pressure and suction surfaces. The thinness of the squealer walls will ensure that the leakage flow over said wall will remain separated, thereby avoiding increased heatload that would arise should the leakage flow reattach to the top of the squealer. In the arrangement in FIG. 2, the squealer tip walls are rather fatter and shorter. A convective cooling arrangement is slightly closer in FIG. 2 and the proximity of the cooling, relative to the squealer tip, may reduce the metal temperature of said tip. However, the thickness of the wall may encourage re-attachment of the air flowing between the upper end of the tip wall and the casing as the blade rotates. This reattachment would tend to increase the heat transfer.

Various squealer tip geometries and cooling constructions are known. In U.S. Pat. No. 5,660,523, the squealer tip has an extremely thick wall with an outer peripheral groove defined in an outer surface of the squealer tip wall. The cooling air is ducted from inside the blade to a series of apertures in the peripheral groove.

In U.S. Pat. No. 6,190,129, the squealer tip is spaced inbound from the outer edge of the aerofoil blade proper and a series of cooling apertures are formed in the upper surface of the aerofoil blade proper to direct cooling flow of air upwardly past the squealer tips. In U.S. Pat. No. 6,602,052 a shallow squealer tip is provided and a cooling passageway extends from the interior of the aerofoil blade to the face of the pressure-side wall of the aerofoil blade. A similar arrangement is shown in U.S. Pat. No. 6,790,005. The squealer tip is slightly deeper.

It is an object of the invention to provide an improved aerofoil.

According to the invention there is provided an aerofoil comprising a pressure-side wall, a suction-side wall and an intermediate wall extending from a free end of the pressure-side wall at an acute angle relative thereto towards the suction-side wall, a cooling fluid passageway extending through a region where the intermediate wall meets the pressure-side wall at an apex, and the fluid passageway has an opening, at least in part, in the face of the pressure-side wall.

In that way, because the intermediate wall is separate from the pressure-side wall, the intermediate wall is not overly thick which reduces the volume of material that is required to be cooled, unlike that taught in U.S. Pat. No. 5,660,523 and U.S. Pat. No. 6,602,052.

Preferably the fluid passageway extends substantially parallel to the plane of the intermediate wall. Preferably the fluid passageway extends at least partially within the intermediate wall. These arrangements are advantageous as cooling fluid is passed directly over the region of the aerofoil that is most prone to extreme heat.

The fluid passageway preferably has an opening in the face of the pressure-side wall. The opening in the pressure-side wall is preferably arranged just below the point where the intermediate wall meets the pressure-side wall. The cooling fluid passageway opening of the pressure-side wall forms an outlet. The inlet is preferably arranged on the underside of the intermediate wall.

The intermediate wall meets the pressure-side wall at an apex. The tip of the apex is preferably less than or equal to 1.0 mm in width in the direction from the pressure-side wall to the suction-side wall.

Where the aerofoil is arranged within a casing, the distance between the uppermost point of the intermediate wall and the casing is the tip gap. The width of the uppermost part of the intermediate wall is the pressure-side squealer tip width. Preferably, the tip gap is at least the same size as the pressure-side squealer tip width, most preferably at least twice the size.

The intermediate wall preferably extends from the pressure-side wall to the suction-side wall. The intermediate wall may extend diagonally downwardly from the pressure-side wall to the suction-side wall such that it is N-shaped in section. In such a case, the intermediate wall may curve so that the angle of the intermediate wall relative to the suction-side wall at the point that it meets the suction-side wall is substantially normal. Alternatively, the intermediate wall may be V-shaped in section so that it extends downwardly from the free end of the pressure-side wall to an approximate point and then extends upwardly to the suction-side wall. Alternatively, the intermediate wall may be M-shaped. Alternatively, more than one N-shaped intermediate wall section is provided to form a multiple squealer arrangement, for example having a NN-shaped section or NNN-shaped section.

The angle between the pressure-side wall and the intermediate wall is preferably in the range 10°-60° degrees. The angle between the intermediate wall and the suction-side wall at the point at which they meet is preferably in the range 45°-90° degrees.

Preferably the cooling fluid passageway extends from an inlet opening in the intermediate wall to an inlet opening in the face of the pressure-side wall. Additionally, the cooling fluid passageway may also extend from the inlet opening to an outlet opening in the face of the suction-side wall.

The cooling fluid passageway is preferably arranged so that cooling fluid emerging from the passageway has a component of velocity which opposes, in use, the over-tip airflow.

The height of the intermediate wall from its lowest point to its highest point is preferably in the range 2-15% of the overall height of the aerofoil.

Embodiments of the invention will now be described in detail by way of example and with reference to the accompanying drawings, in which:

FIG. 1 (PRIOR ART) and FIG. 2 (PRIOR ART) are schematic part-sectional views of known gas turbine aerofoil squealer tips;

Figure 1:
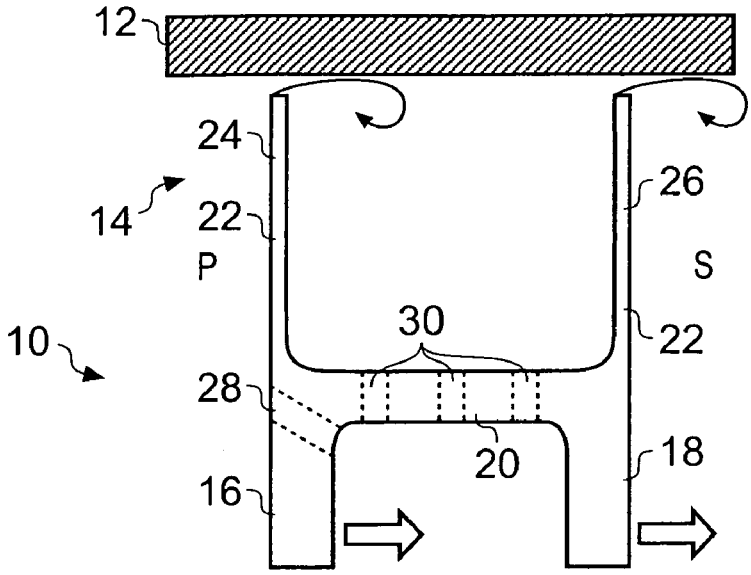
FIG. 1 (Prior Art)

In FIG. 1 (PRIOR ART), the outer end of an aerofoil 10 is shown. The aerofoil 10 runs in a gas turbine engine with a casing 12 and the top of an aerofoil 10 is protected by means of a squealer tip arrangement 14. The aerofoil 10 has aerofoil sidewalls 16, 18 and a top wall 20. The squealer tip arrangement comprises a squealer tip wall 22 which extends around the periphery of the top wall 20 of the aerofoil 10. In use, the aerofoil moves from left to right as viewed in FIG. 1 so that the left-hand side of the aerofoil is the pressure-side and the right-hand side of the aerofoil is the suction-side. The pressure-side wall 24 of the peripheral squealer tip wall 22 is thus on the left-hand side as viewed in FIG. 1 (indicated by "P") and the suction-side wall 26 of the squealer tip wall 22 is formed on the right-hand side (indicated by "S"). The squealer wall 24 has a high aspect ratio (length:width) that would make it difficult to cool convectively. Film cooling passage(s) 28 may positioned through the sidewall 16 from the interior of the aerofoil 10, emerging at the face of the sidewall that faces the pressure side. Also, additional cooling apertures 30 may be positioned in top wall 20.

Figure 2:
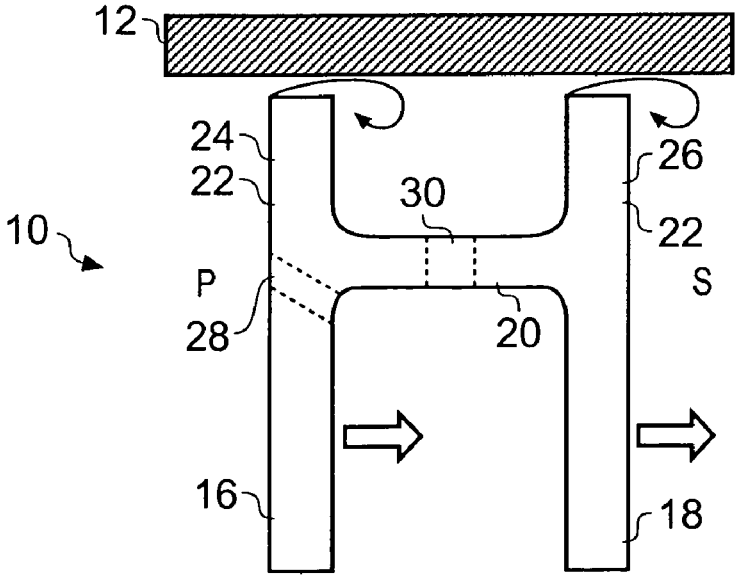
FIG. 2 (Prior Art)

The aerofoil 10 in FIG. 2 (PRIOR ART) is similar in many respects to that in FIG. 1 and parts corresponding to parts in FIG. 1 carry the same reference numerals. In FIG. 2 the squealer tip wall 22 has a lower aspect ratio than the geometry shown in FIG. 1, which would make it easier to cool convectively. The drawbacks of both these arrangements have been described earlier.

Figure 3:
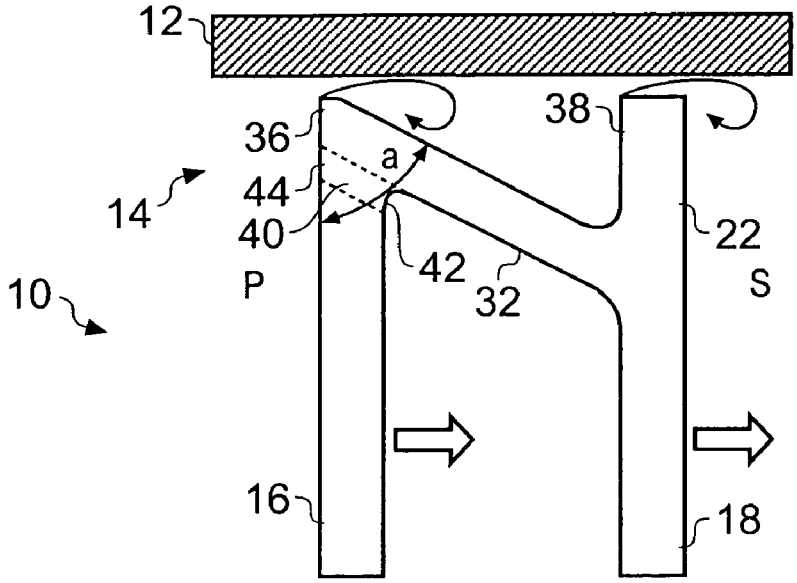
FIG. 3 is a schematic sectional view through part of an aerofoil having an "N" shaped intermediate wall in accordance with the invention.

In FIG. 3, parts corresponding to parts in FIGS. 1 and 2 carry the same reference numerals. In FIG. 3 an aerofoil 10 in accordance with the invention is arranged to run close to the inner surface of an engine casing 12. The aerofoil 10 includes sidewalls 16, 18 and a squealer tip arrangement 14.

The squealer tip arrangement 14 of FIG. 3 comprises an inclined intermediate squealer wall 32 which extends diagonally downwardly from the top of the side wall 16, which is the pressure-side wall in FIG. 3 as indicated by the letter P, to the bottom of the suction surface squealer tip wall 22, to form an N-shape. The intermediate squealer wall 32 and the pressure-side wall 16 meet at an apex 36. The second squealer tip wall 22 is nominally vertical with an apex 38.

A cooling passage 40 is provided in the pressure-side squealer wall 16. The cooling passage 40 extends through a region where the intermediate wall 32 meets the pressure-side wall 16, and extends from an inlet opening 42 in the underside of the intermediate squealer wall 32 to an outlet opening 44 in the face of the pressure-side wall 16. In the embodiment presented in FIG. 3 the cooling passage extends parallel to a line along which the pressure side wall 16 meets the intermediate wall 32. That is to say the passageway 40 of this embodiment extends parallel to the plane of the diagonal (or "downwardly extending") section of the intermediate wall 32, where the plane is defined by the radially inner and outer surfaces of the intermediate wall 32. The line along which the pressure side wall 16 meets the intermediate wall 32 is parallel to the dotted line defining the upper edge of the passageway 40 as shown in FIG. 3, and is also parallel to the radially inner and radially outer surfaces of the intermediate wall 32. The cooling passage 40 may be inclined axially (ie at an angle to the plane of the figure as shown), so that the image in FIG. 3 is a projection and not the actual length of the cooling passage.

Cooling air is ducted internally of the aerofoil 10 so that it passes into the inlet 42, along the passageway 40 and out of the outlet 44. The main part of the passageway 40 is substantially parallel to the first squealer wall 32. Thus, cooling air emerging from the outlet 44 has a radial component of velocity (ie in the direction from top to bottom as presented in the figures) and an axial component (ie into the plane of figure). This direction of flow opposes the overall flow direction of air relative to the moving aerofoil. This flow of cooling air, which opposes the over-tip flow, reduces the over-tip flow, which can improve the aerodynamic performance of the aerofoil 10. Air that does pass over the tip eddies and creates drag. The angle "a" between the span-wise direction of the pressure-side wall 16 and the upper surface of the first intermediate squealer wall 32 is in the range from 10°-60° degrees. Preferably the intermediate squealer wall 32 extends from the pressure side wall 16 of the aerofoil 10 at an angle "a" of approximately 45° degrees to the pressure-side wall 16. This ensures that any over-tip flow of air does not attach on the apex 36 or onto the squealer wall 32, which reduces the heat load on the aerofoil. The provision of a cooling fluid passageway within the squealer wall 32 delivers cooling to the part of the aerofoil that is most prone to heat distress.

Figure 4:
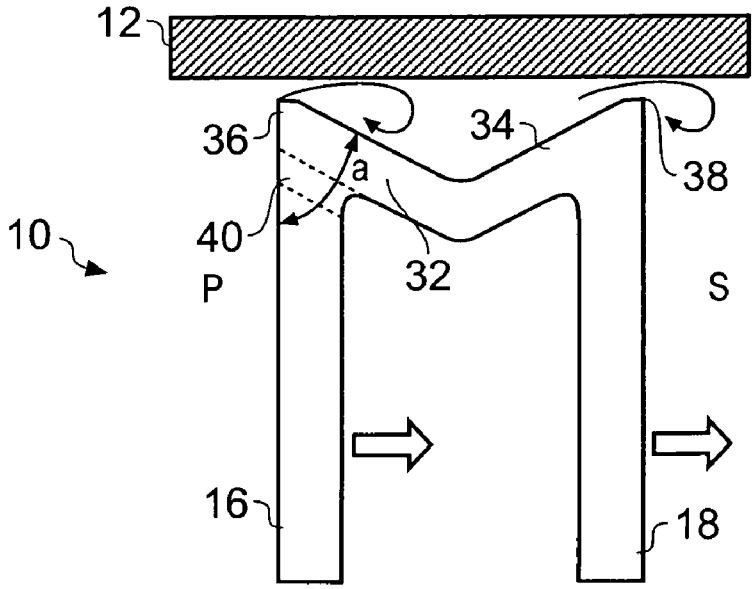
FIG. 4 is a schematic sectional view through part of an aerofoil having an "V" shaped intermediate wall in accordance with a further embodiment of the invention.

Presented in FIG. 4 is an aerofoil 10 which is similar in many respects to that shown in FIG. 3 and parts corresponding to parts in FIG. 3 carry the same reference numerals. The aerofoil 10 in FIG. 4 has two inclined squealer walls 32, 34. The inclined squealer wall 32 is inclined radially inwards from the apex 36 and the inclined squealer wall 34 is inclined radially outwards towards an apex 38. That is to say the intermediate wall is V-shaped in section so that it extends downwardly from the free end of the pressure-side wall 16 (ie apex 36) to an approximate mid point and then extends upwardly to the suction-side wall 18 (ie apex 38). The angle "a" between the inclined squealer wall 32 and the pressure sidewall 16 and between the inclined squealer wall 34 and the suction-side wall 18 is preferably in the range 10-60° degrees. The cooling fluid passageway 40 is formed in the pressure side wall 16 which passageway functions in a similar manner to that in FIG. 3. It is believed that the suction-side wall 18 would perform better in the FIG. 3 configuration than that shown in FIG. 4.

Figure 5:
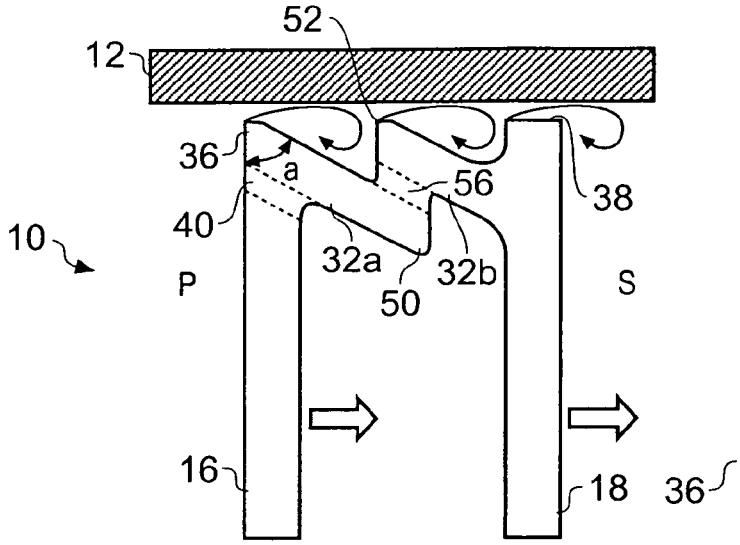
FIG. 5 is a schematic sectional view through part of an aerofoil having an "NN" shaped intermediate wall in accordance with a further embodiment of the invention.

Presented in FIG. 5 is an aerofoil 10 which is similar in many respects to that shown in FIG. 3 and FIG. 4 and parts corresponding to parts in FIG. 3 and FIG. 4 carry the same reference numerals. The aerofoil 10 in FIG. 5 is substantially similar to that in FIG. 3 except that the intermediate wall 32 has two "N" shaped sections which forms a "NN"-shaped section. The intermediate wall 32 has a first portion 32*a* which extends downwardly from the free end of the apex 36 of the pressure-side wall 16 to an approximate mid point 50 and then extends substantially vertically upwards to a peak 52. The intermediate wall 32 also has a second portion 32*b* which extends downwardly from the peak 52 to the suction-side wall 18. The angle between the first portion 32*a* and the pressure sidewall 16 and between the second portion 32*b* and the suction-side wall 18 is preferably in the range 10-60° degrees. A cooling fluid passageway 40 is formed in the pressure side wall 16, and a further cooling fluid passageway 56 is formed in the vertical section of the intermediate wall 32. These passageways function in a similar manner to that in FIG. 3.

Figure 6:
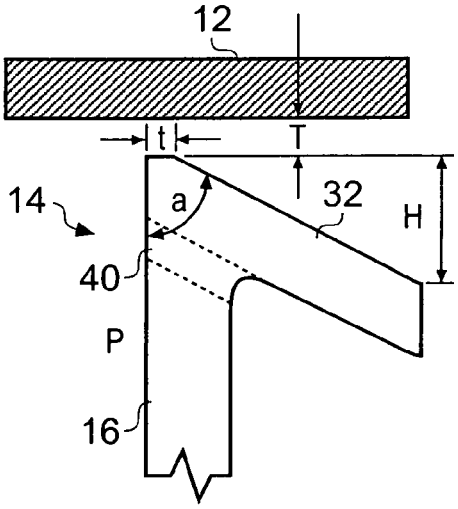
FIG. 6 is an enlarged view of a region where an intermediate wall meets a pressure-side wall of the aerofoil.

FIG. 6 shows various dimensions in relation to the aerofoil of FIG. 3, FIG. 4 and FIG. 5. The squealer height H is the radial distance from the apex 36 to the lower most point of the upper surface of the squealer wall 32. This height H should be in the range of 2-15% of the overall height of the aerofoil 10. The circumferential extent (that is to say, the "width") of the apex t is shown in FIG. 6. It is preferred that the apex is a sharp tip. However, a small squealer tip width is acceptable. The tip gap T is the distance between the inner surface of the outer casing 12 and the apex 36. The squealer tip width t should not be larger than the tip gap T. Preferably, the tip gap T should be at least twice the squealer tip width t. Generally the tip gap T would be no more than one 1 mm. Consequently, the squealer tip width should be no more than 0.5 mm.

Figure 7:
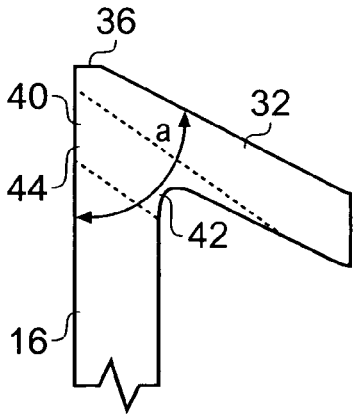
FIG. 7 shows an alternative embodiment to that presented in FIG. 6, with the cooling passageway in a different location relative to the surfaces of the intermediate wall.

An alternative arrangement is presented in FIG. 7 in which the cooling passage 40 extends through a region where the intermediate wall 32 meets the pressure-side wall 16, with the fluid passageway 40 extending at least partially within the intermediate wall 32. Additionally the passageway of this embodiment extends at an angle to the plane of the diagonal (or "downwardly extending") section of the intermediate wall 32, such that the outlet 40 is located towards the apex 36. That is to say, the outlet opening 44 is located between the apex 36 and the line along which the pressure side wall 16 meets the intermediate wall 32.

Figure 8:
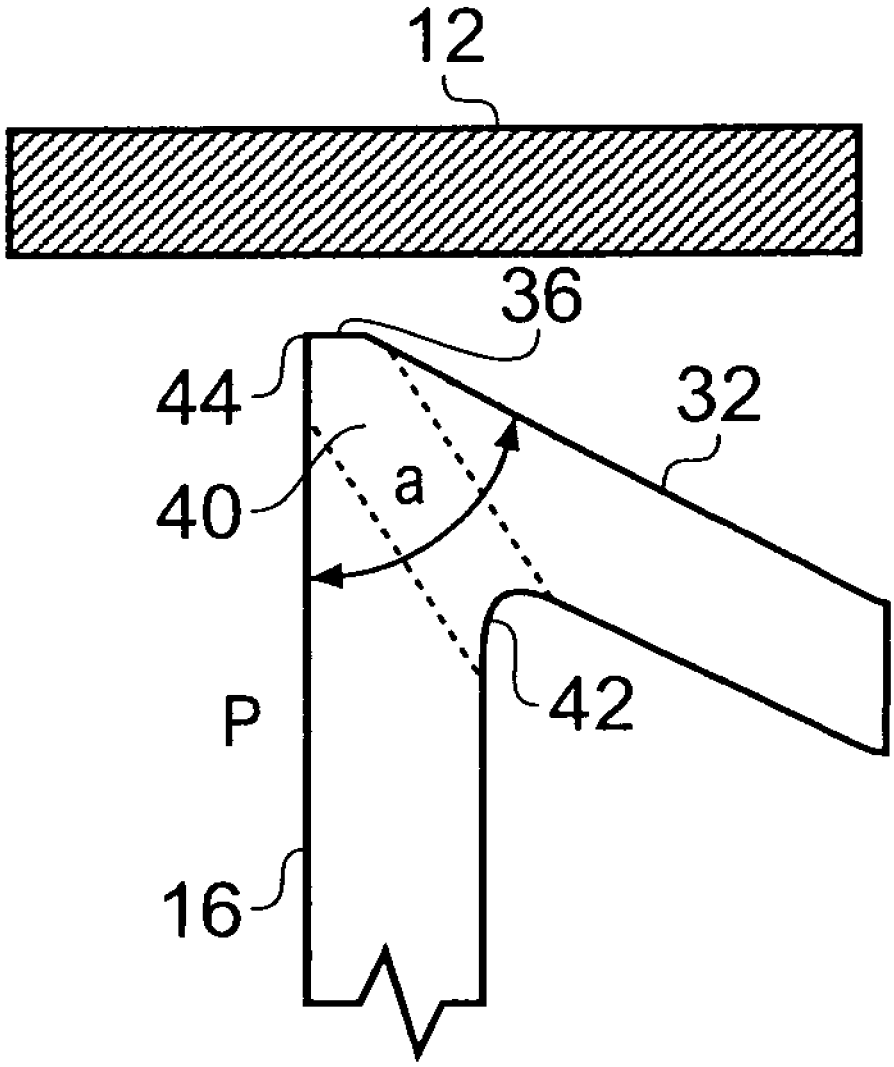
FIG. 8 shows a further alternative embodiment to that presented in FIG. 7, showing an embodiment in which the cooling passageway is provided at a different location in the intermediate wall.

In an alternative embodiment, shown in FIG. 8, the angle of the passageway 40 relative to the plane of the diagonal (or "downwardly extending") section of the intermediate wall 32 is such that the outlet opening 44 coincides with the apex 36.

The present invention provides alternative squealer tip geometry to allow cooling to be delivered directly to the squealer tip. The heat loading on the squealer tip of the present invention is reduced due to the small squealer tip width and the angle relationship between the squealer wall and the pressure-side wall. Still further, directing cooling fluid to emerge just below the apex between the pressure-side wall 16 and the squealer wall 32, or at the apex 36 improves the aerodynamics of the aerofoil 10 by reducing the over-tip flow.

The invention claimed is:

1. An aerofoil comprising:

a pressure-side wall, a suction-side wall, and an intermediate wall, the intermediate wall extending from a free end of the pressure-side wall diagonally downwardly at an acute angle relative thereto, and meeting the suction-side wall at a distance from a free end of the suction-side wall to form an "N"-shape, and a cooling fluid passageway extending through a region where the intermediate wall meets the pressure-side wall at an apex, and the fluid passageway has an opening, at least in part, in the face of the pressure-side wall.

2. An aerofoil according to claim 1, in which the tip of the apex is less than or equal to 0.5 mm in width in the direction from the pressure-side wall to the suction-side wall.

3. An aerofoil according to claim 1 in which the fluid passageway extends substantially parallel to the plane of the intermediate wall.

4. An aerofoil according to claim 1 in which the fluid passageway extends at an angle to the plane of the intermediate wall.

5. An aerofoil according to claim 1 in which the fluid passageway extends at least partially within the intermediate wall.

6. An aerofoil according to claim 1 in which the opening in the pressure-side wall is arranged just below the point where the intermediate wall meets the pressure-side wall.

7. An aerofoil according to claim 1, in which the cooling fluid passageway opening of the pressure-side wall forms an outlet and an inlet is arranged on the underside of the intermediate wall.

8. An aerofoil according to claim 1, in which the fluid passageway has an opening which forms an outlet at the apex, and an inlet is arranged on the underside of the intermediate wall.

9. An aerofoil according to claim 1, in which the aerofoil is arranged within a casing, the distance between the uppermost point of the intermediate wall and the casing is the tip gap, the width of the uppermost part of the intermediate wall is the pressure-side squealer tip width and the tip gap is at least the same size as the pressure-side squealer tip width.

10. An aerofoil according to claim 9 in which the tip gap is at least twice the size of the pressure-side squealer tip width.

11. An aerofoil according to claim 1, in which the intermediate wall is V-shaped in section so that it extends downwardly from the free end of the pressure-side wall to an approximate mid point and then extends upwardly to the suction-side wall.

12. An aerofoil according to claim 1, in which the intermediate wall is "NN"-shaped in section so that it extends downwardly from the free end of the pressure-side wall to an approximate mid point, extends substantially vertically upwards to a peak, and then downwardly from the peak to the suction-side wall.

13. An aerofoil according to claim 1, in which the intermediate wall extends diagonally downwardly from the pressure-side wall to meet the suction-side wall.

14. An aerofoil according to claim 1, in which the angle between the pressure-side wall and the intermediate wall is in the range 10°-60° degrees.

15. An aerofoil according to claim 1, in which the cooling fluid passageway is arranged so that cooling fluid emerging from the passageway has a component of velocity which, in use, opposes the over-tip airflow.

16. An aerofoil according to claim 1, in which the height of the intermediate wall from its lowest point to its highest point is preferably in the range 2-15% of the overall height of the aerofoil.

* * * * *